US005441111A

United States Patent [19]

Whiteford

[11] Patent Number: 5,441,111

[45] Date of Patent: Aug. 15, 1995

[54] BRIDGE PLUG

[75] Inventor: Drummond Whiteford, Multimber, England

[73] Assignee: Petroleum Engineering Services Limited, Aberdeen, United Kingdom

[21] Appl. No.: 204,679

[22] Filed: Mar. 1, 1994

[51] Int. Cl.[6] ..... E21B 33/127

[52] U.S. Cl. ..... 166/387; 166/123; 166/134; 166/135

[58] Field of Search ..... 166/118, 123, 134, 135, 166/214, 215, 387

[56] References Cited

U.S. PATENT DOCUMENTS

| | | | |
|---|---|---|---|
| 3,575,237 | 4/1971 | Malone | 166/187 X |
| 3,602,305 | 8/1971 | Kisling, III . | |
| 4,018,274 | 4/1977 | Cochran . | |
| 4,284,137 | 8/1981 | Taylor . | |
| 4,411,435 | 10/1983 | McStravick | 166/136 X |
| 4,438,933 | 3/1984 | Zimmerman | 166/134 X |
| 4,515,213 | 5/1985 | Roger et al. | 166/134 X |
| 4,548,265 | 10/1985 | Luke . | |
| 4,697,640 | 10/1987 | Szarka | 166/120 |

FOREIGN PATENT DOCUMENTS

| | | |
|---|---|---|
| 094169 | 11/1983 | European Pat. Off. . |
| 2155521 | 9/1985 | United Kingdom . |

*Primary Examiner*—William P. Neuder
*Attorney, Agent, or Firm*—Popham, Haik, Schnobrich & Kaufman, Ltd.

[57] ABSTRACT

This invention relates to a retrievable bridge plug for use in down-hole casing or tubing conduit. A problem exists in known plugs, namely slippage thereof within the casing resulting in breakage of a seal therebetween. The present invention provides a plug which can be set by urging outermost and innermost cylindrical members relative to one another in their longitudinal directions in so doing anchoring slips 19*a*, 19*b* and locating a packing element 11*a*, 11*b* on an inner surface of the casing, biasing means 30*a*, 30*b* providing a predetermined force to the packing element 11*a*, 11*b* greater than that required to provide a seal whereby the plug is retained within the casing.

10 Claims, 6 Drawing Sheets

BRIDGE PLUG

Figure 1:
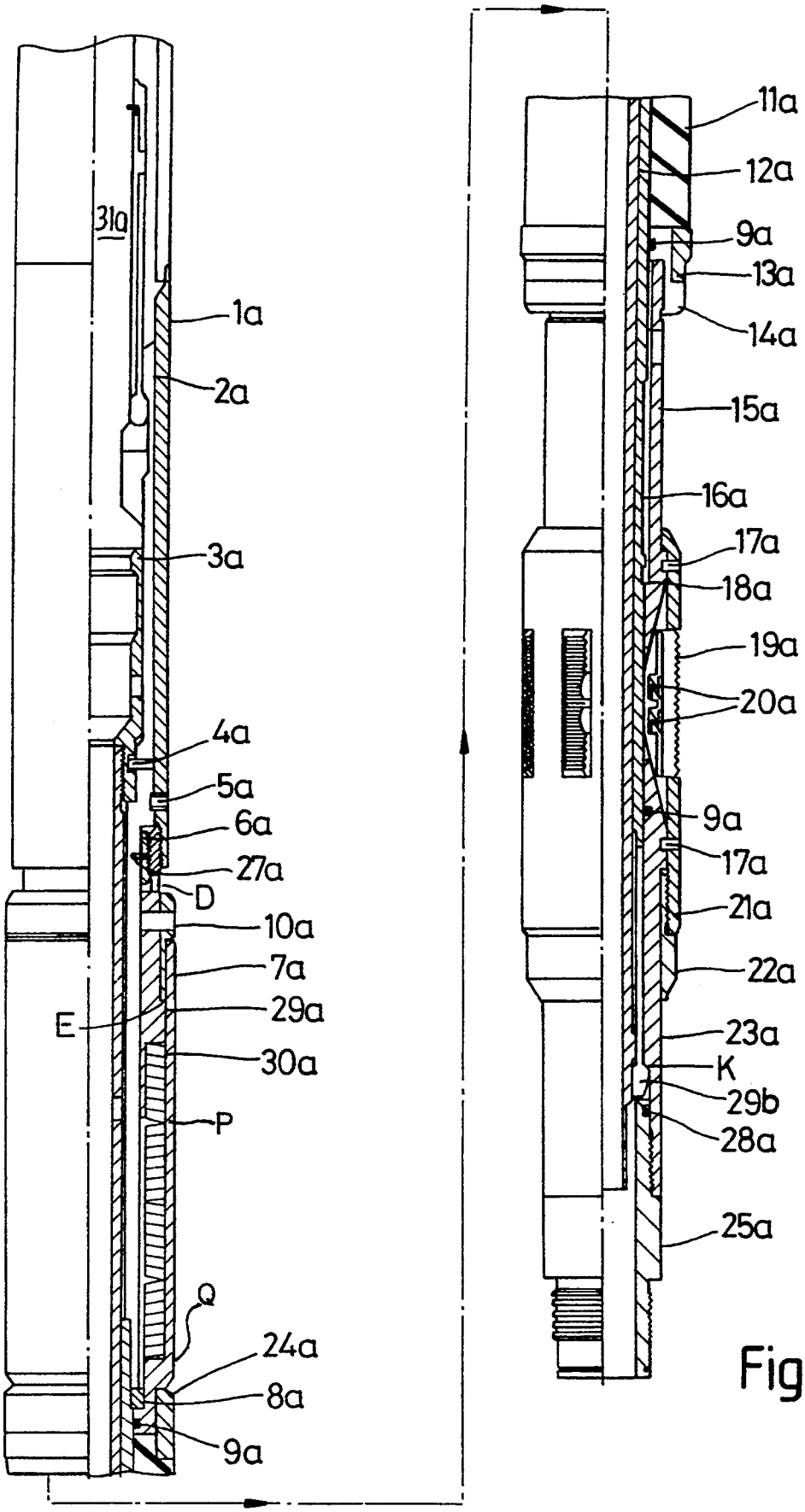

This invention relates to a retrievable bridge plug for use in down-hole casing or tubing conduit, e.g. in the petro-chemical drilling industry.

Retrievable bridge plugs used to maintain a down-hole differential pressure are known. Such plugs may also be used as hydraulic or electric line set back pressure valves, carrier devices for amarada gauges, injection valves or the like, or suspension plugs.

The plugs are typically run down-hole, using a running tool, to a desired depth. The plug is then set using an electric wireline pressure setting assembly.

In this way, a barrier device, i.e. the plug, can be placed at a predetermined point in a casing or tubing conduit. A number of such plugs can be placed at different depths down-hole in order to maintain a series of down-hole differential pressures. A plug can subsequently be retrieved from the casing or tubing conduit by a pulling tool, e.g. employing slick line, branded line, coiled tubing or workstring.

A problem exists in known bridge plugs in that when they are set in position, a packing element and slip mechanism exerts a predetermined load on the inner walls of the casing or tubing conduit. Since, over a period of time the internal dimensions of the casing or tubing conduit may alter due to corrosion or scaling, slippage of the plug within the casing or tubing conduit may occur resulting in breakage of the seal. Slippage of the plug may also occur due to creep of the packing element.

In this way the differential pressure may vary from that which is desired. This problem also exists in casing or tubing conduit having an irregular internal surface.

It is therefore an object of the present invention to obviate or mitigate the aforementioned disadvantages.

Accordingly, a first aspect of the present invention provides a retrievable bridge plug for use in a casing or tubing conduit, comprising a plurality of outermost substantially cylindrical members dependent from one another, and a plurality of innermost substantially cylindrical members dependent from one another, a packing element, an outer surface of which engages an inner surface of the casing or tubing conduit, in use, so as to provide a seal thereat, a plurality of slips dispersed around the outer surface of the plug, and further comprising biasing means held longitudinally between two of the outermost members, wherein, in use, the plug can be set by urging the outermost members and innermost members relative to one another in their longitudinal directions in so doing anchoring the slips and locating the packing element on the inner surface of the casing or tubing conduit, the biasing means providing a predetermined force to the packing element greater than that required to provide the seal whereby the plug is retained within the casing or tubing conduit.

In this way, slippage of the plug within the casing or tubing conduit can be reduced and any pressure differential maintained.

The biasing means may be in the form of a disc spring, and may advantageously be a Belville washer.

The packing element is preferably made from an elastomeric material.

In a first embodiment of the present invention, the plurality of outermost substantially cylindrical members comprises a setting sleeve, an inner facing surface at a lower end of which is in contact with an outer surface of an upper end of a lock ring housing, a lower facing surface of which is in abutment with an upper end of the biasing means, a lower end of the biasing means being in abutment with an upper facing surface of a housing, a lower facing surface of the housing being in abutment with an upper facing surface of the packing element, a lower facing surface of the packing element being in abutment with an upper facing surface of a gauge ring support, a lower facing surface of the gauge ring support being in abutment with an upper facing surface of an upper cone, an angled lower facing surface at a lower end of the upper cone being in contact with corresponding angled upper facing surfaces of a plurality of slips, the slips having further symmetrical lower facing surfaces which contact a corresponding upper facing surface provided on an upper end of a lower cone, a lower end of the lower cone being in contact with an upper facing surface of an accessory cross-over.

In the first embodiment, the plurality of innermost substantially cylindrical members comprises a running head, a lower end of which abuts a lower facing surface of a stop ring, a lower facing surface of the stop ring abutting a further upper facing surface of the housing, wherein a further lower facing surface of the running head abuts an upper facing surface of a main mandrel, the lower end of the main mandrel being provided with a collet finger, an angled upper facing surface of which abuts a corresponding angled lower facing surface of the lower cone, further comprising an inner mandrel, an outer surface of which is in contact with an inner surface of the main mandrel, an upper surface of the inner mandrel being in abutment with a lower facing surface of a fishing neck.

In a second embodiment of the present invention, the plurality of outermost substantially cylindrical members comprises a setting sleeve, an inner facing surface at a lower end of which is in contact with an outer surface of an upper end of a lock ring housing, a lower facing surface of which is in abutment with an upper facing surface of a first annular member, a lower facing surface of which is in abutment with an upper facing surface of the packing element, a lower facing surface of which is in abutment with an upper facing surface of a gauge ring support, a lower facing surface of the gauge ring support being in abutment with an upper facing surface of a first cylindrical member, a lower facing surface of which is in abutment with an upper end of the biasing means, a lower end of the biasing means being in abutment with an upper facing surface of a housing, a lower facing surface of the housing being in abutment with an upper facing surface of an upper cone, an angled lower facing surface at a lower end of the upper cone being in contact with corresponding angled upper facing surfaces of a plurality of slips, the slips having further symmetrical lower facing surfaces which contact a corresponding upper facing surface provided on an upper end of a lower cone, a lower end of the lower cone being in contact with an upper facing surface of an accessory cross-over.

In the second embodiment, the plurality of innermost substantially cylindrical members comprises a running head, a lower end of which abuts a lower facing surface of a stop ring, a lower facing surface of the stop ring abutting a further upper facing surface of the lock ring housing, wherein a further lower facing surface of the running head abuts an upper facing surface of a main mandrel, the lower end of the main mandrel being provided with a collet finger, an angled upper facing surface of which abuts a corresponding angled lower facing surface of the lower cone, further comprising an inner mandrel, an outer surface of which is in contact with an inner surface of the main mandrel, an upper surface of the inner mandrel being in abutment with a lower facing surface of a fishing neck.

According to a second aspect of the present invention there is provided a method of locating and retaining a bridge plug within a casing or tubing conduit, the bridge plug comprising a plurality of outermost substantially cylindrical members dependent from one another, and a plurality of innermost substantially cylindrical members dependent from one another, a packing element an outer surface of which engages an inner surface of the casing or tubing conduit, in use, so as to provide a seal thereat, and a plurality of slips disposed around the outer surface of the plug, the method comprising setting the plug at a desired position in the casing or tubing conduit by urging the outermost and innermost members relative to one another in their longitudinal directions, in so doing anchoring the slips and locating the packing element on the inner surface of the casing or tubing conduit, and providing a predetermined force to the packing element greater than that required to provide a seal by means of biasing means held longitudinally between two of the outermost members, whereby the plug is retained within the casing or tubing conduit.

According to a third aspect of the present invention there is provided a retrievable bridge plug according to the first aspect, wherein the biasing means also acts to improve releasing of the plug on retrieval.

Figure 2A:
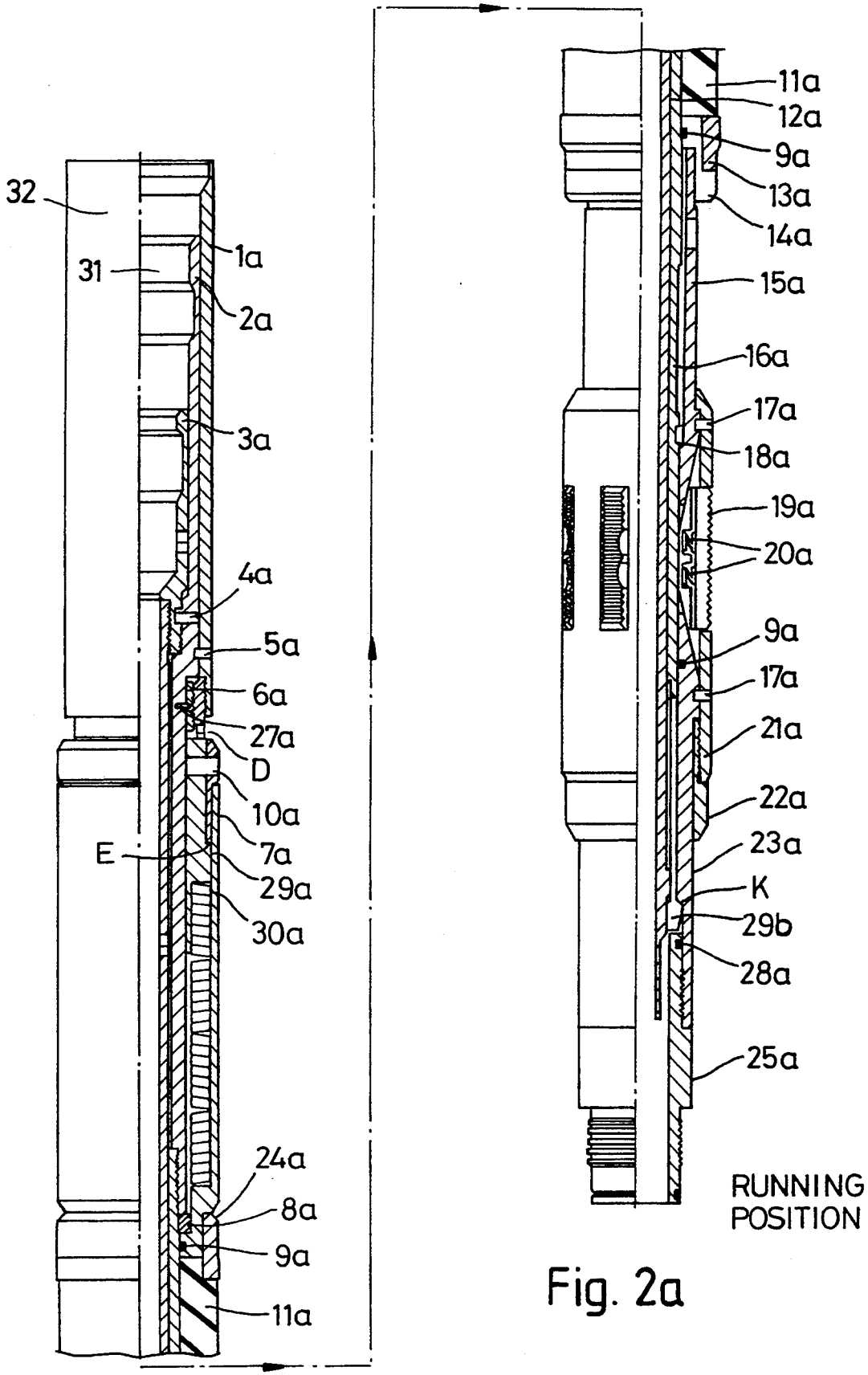
Figure 2B:
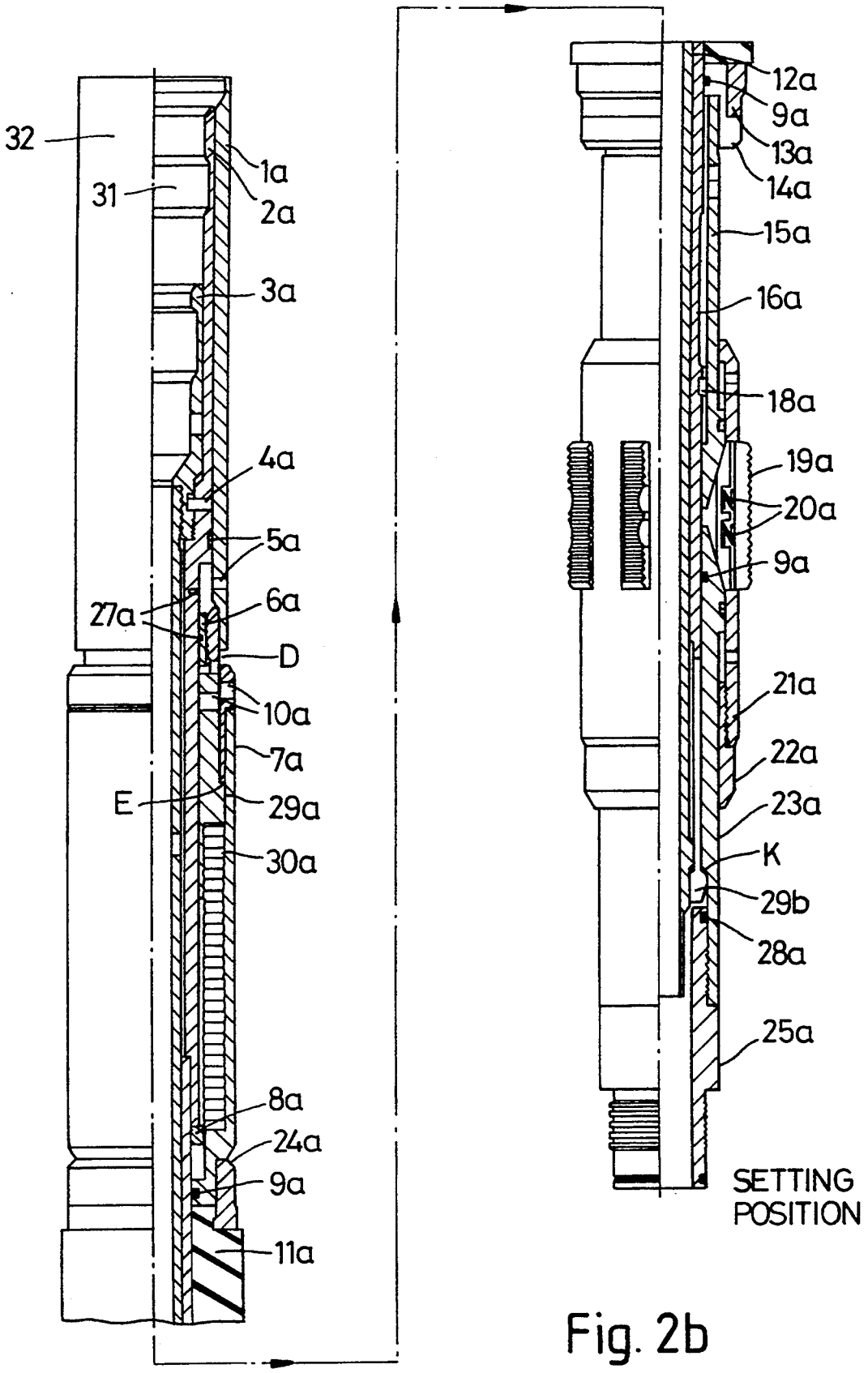
Figure 2C:
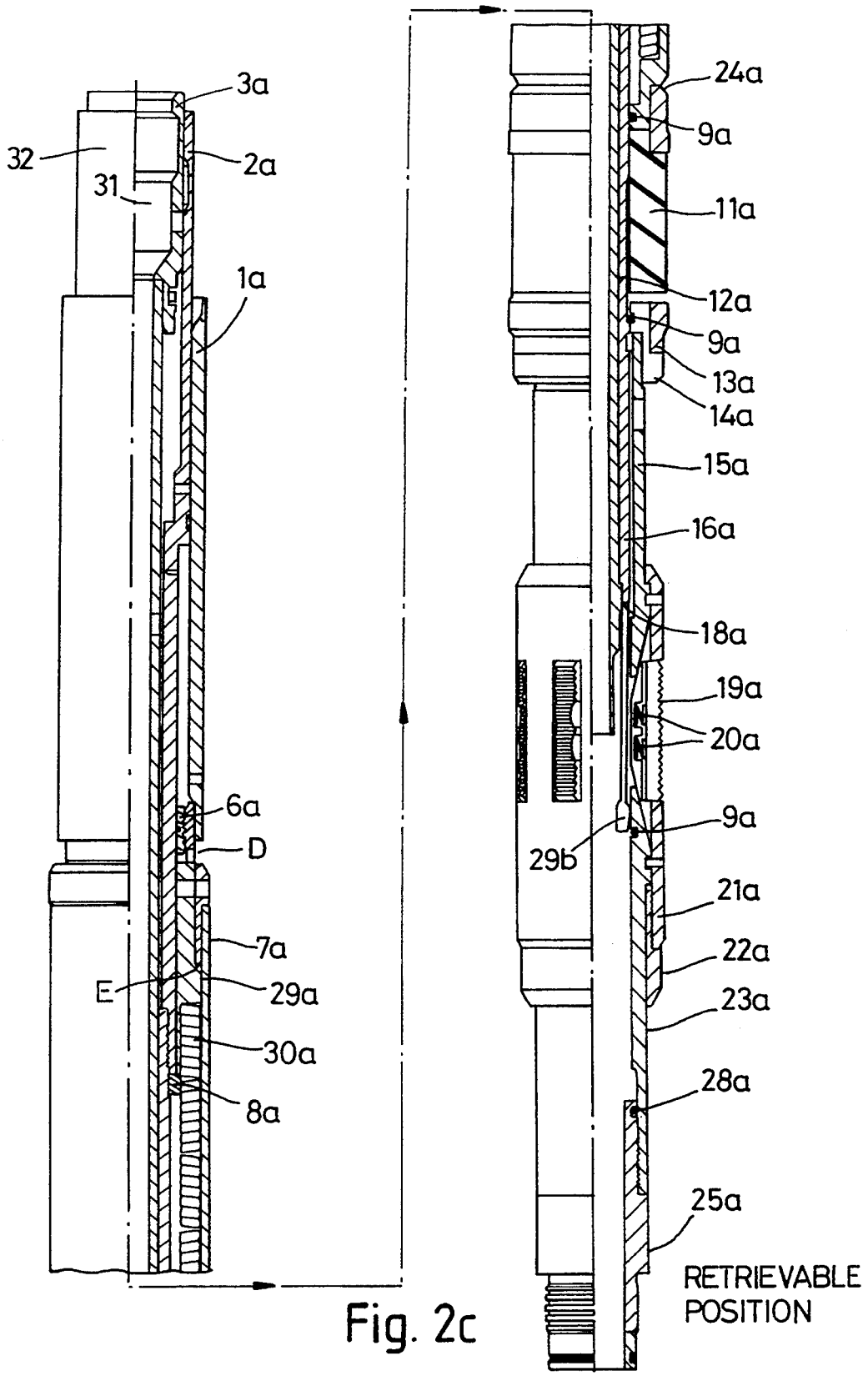
Figure 3:
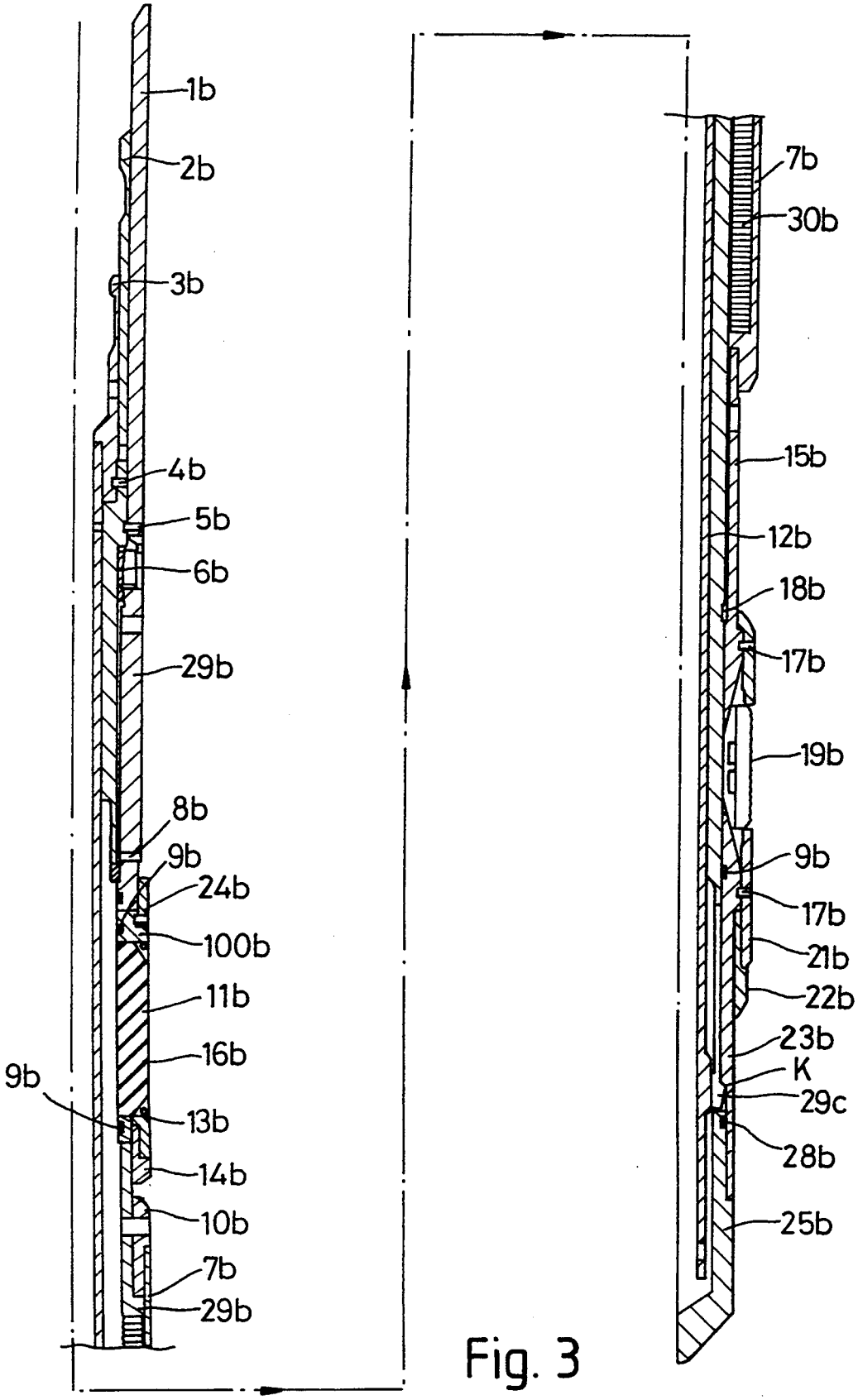
Figure 4:
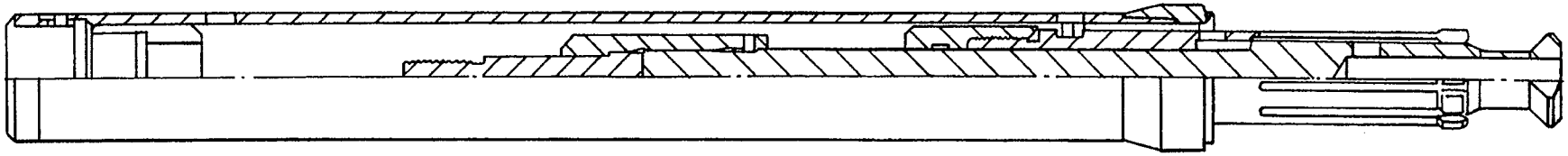
Figure 5:
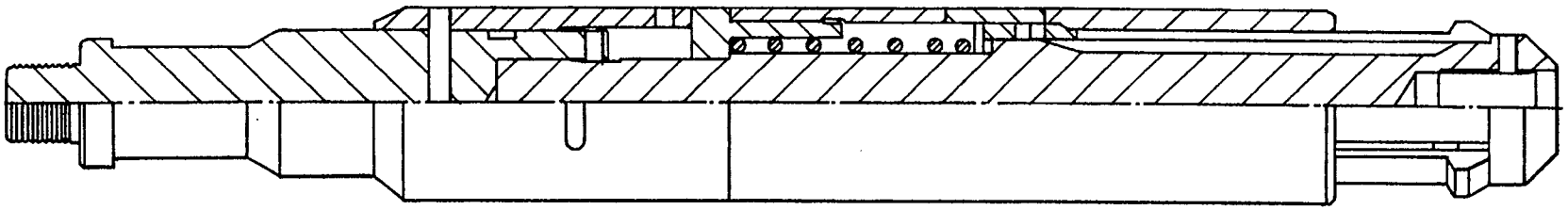

Two embodiments of the present invention will now be described, by way of example only, with reference to the accompanying drawings which are:

FIG. 1 a side view in partial cross section of a first embodiment of a retrievable bridge plug according to the present invention;

FIGS. 2(*a*),(*b*),(*c*) a series of drawings showing side views in partial cross-section of the retrievable bridge plug of FIG. 1 in running, setting and retrieval positions respectively;

FIG. 3 a side view in cross-section of half of a second embodiment of a retrievable bridge plug according to the present invention FIG. 4 a side view of a running tool for use with the retrievable bridge plug of FIGS. 1 or 3; and FIG. 5 a side view of a pulling tool for use with the retrievable bridge plug of FIGS. 1 or 2.

DESCRIPTION OF A FIRST EMBODIMENT

Referring to FIG. 1, there is provided a first embodiment of a retrieval bridge plug according to the present invention comprising a setting sleeve 1*a* having a plurality of shear screws 5*a* spaced therearound at or near a lower end thereof. Also at or near the lower end of the setting sleeve 1*a* there is provided a lock ring 6*a* having a ratchet mechanism. Between the lower end of the setting sleeve 1*a* and the lock ring 6*a* there is provided an upper end of a lock ring housing 29*a*. At a lower facing end of the lock ring housing 29*a*, attached thereto, is a disc spring assembly 30*a*. The disc spring 30*a* may advantageously take the form of a Belville washer. The lower end of the disc spring 30*a* abuts an upper facing surface of a housing 7*a*, a lower facing surface of the housing 7*a* abutting an upper facing surface of a packing element 11*a*. The upper facing surface of the packing element 11*a* is so shaped as to receive an upper gauge ring 24*a* around an external outer surface thereof. Further, a first o-ring 9*a* is provided within a first recess in the inner surface of the housing 7*a* at or near the lower edge thereof.

Provided between an outer surface of the lock ring housing 29*a* and an inner surface at the upper edge of the housing 7*a* is a housing connector 10*a*.

The lower end of the packing element 11*a* abuts a gauge ring support 14*a* the outer surface of which is so shaped so as to receive a lower gauge ring 13*a* therein, an upper surface of the lower gauge ring 13*a* also being in abutment with the lower surface of the packing element 11*a*. A second recess is provided on the inner surface of the gauge ring support 14*a* at or near the upper end thereof suitable for receiving a second o-ring 9*a*. A lower facing surface of the gauge ring support 14*a* abuts an upper facing surface of an upper cone 15*a* which is shear pinned via shear screws 17*a* to a slip cage 21*a*. The slip cage 21*a* has a plurality of apertures spaced substantially equally therearound suitable for allowing the expansion or contraction of a plurality of slips 19*a* therethrough.

In the interior of the setting sleeve 1*a* is provided a running head 2*a*. The running head 2*a* is attached to the lock ring 6*a* by a brass set screw 27*a*. Further, a lower end of the running head 2*a* abuts an upper facing surface of a stop ring 8*a*, a lower end of the stop ring 8*a* abutting an upper facing surface of the housing 7*a*. A lower facing surface of the running head 2*a* further abuts a main mandrel 16*a*. The main mandrel 16*a* has a third recess in the outer surface thereof to receive a split ring 18*a*, a lower facing surface of the split ring 18*a* abutting an upper facing edge of the upper cone 15*a*.

Provided between an outer surface of the main mandrel 16*a* and the lower end of the slip cage 21*a* is a lower cone 23*a*. On an inner surface of the lower cone 23*a* there is provided a fourth recess for receiving a fourth o-ring 9*a*. The lower cone 23*a* is shear pinned to the slip cage 21*a* via a plurality of shear screws 17*a*. Also provided between a portion of the inner surface of the slip cage 21*a* and the outer surface of the lower cone 23*a*, is a retainer ring 22*a*.

A lower facing surface of the lower cone 23*a* abuts an upper facing edge of an accessory cross-over 25*a*, the accessory cross-over 25*a* having a fifth recess in the outer surface thereof at or near the upper edge thereof capable of receiving a fifth o-ring 28*a*. The fifth recess faces a lower portion of the inner surface of the lower cone 23*a* such that the portion of the inner surface of the lower cone 23*a* and at least a portion of the outer surface of the accessory cross-over 25*a* are in contact with one another.

A lower end of the main mandrel 16*a* is provided with a collet finger 29*a*, an angled upper facing surface of which contacts a corresponding lower facing surface of the lower cone 23*a* at a bearing point K.

Extending substantially the length of the plug is an inner mandrel 12*a*, the outer surface of which is in contact with the inner surface of the main mandrel 16*a*.

Further provided at an upper facing edge of the inner mandrel 12*a* is a fishing neck 3*a*, a lower facing surface of the fishing neck 3*a* being in abutment with an upper facing surface of the inner mandrel 12*a*. The fishing neck 3*a* is further shear pinned to the running head 2*a* via a plurality of shear screws 4*a*.

OPERATION

Running Procedure

Referring to FIG. 2*a*, the plug, run in conjunction with CCL, Collar Correlation Locator, is conveyed into the casing or tubing conduit on conductor line at a slow speed, e.g. around 7500 ft/hr (2287 mi/hr) maximum. The plug may be run using a running tool, as shown in FIG. 4.

When at the required depth the setting assembly is activated. The running tool releases automatically when a predetermined setting load is reached.

Setting Procedure

Referring to FIG. 2*b*, setting force is provided by an electric wireline pressure setting assembly (not shown) using a slow burn power charge. The latter tool is an industry standard, well proven over many years of field use. Setting movement produces an axial upward pull through a core 31 and an axial push through an external sleeve 32, which abut an upper edge of the fishing neck 3*a* and an upper edge of the setting sleeve 1*a* respectively.

The setting sequence is as follows. As the core 31 of the setting tool is pulled up and the external sleeve 32 is pushed down, the setting sleeve 1*a* is pushed down, the first shear screws 5*a* shear, and the lock ring 6*a* ratchets down. The lock ring housing 29*a* is also driven down against the disc springs 30*a*, these in turn driving the housing 7*a* down against the packing element 11*a*, and hence through lower gauge ring 13*a* and gauge ring support 14*a* into upper cone 15*a*.

The upper cone 15*a* is shear pinned to the slip cage 21*a* by shear screws 17*a* (4 off). As the setting tool produces an equal and opposite reaction, while the exterior members 1*a*, 6*a*, 7*a*, 11*a*, 13*a*, 14*a*, 15*a* are being driven down the interior running head 2*a*, stop ring 8*a*, main mandrel 16*a*, split ring 18*a* lower cone 23*a* and the accessory cross over 25*a* are pulled upwards.

The fishing neck 3*a* and inner mandrel 12*a* also move upwards as they are contained inside the running head 2*a* and main mandrel 16*a* respectively, the fishing neck 3*a* and running head 2*a* being attached by shear screws 4*a*.

The lower cone 23*a*, similar to the upper cone 15*a* is shear screwed to the slip cage 21*a* by further shear screws (3 off). Following the initial shear of the shear screws 5*a* a second shear occurs of these three further shear screws 17*a*. The lower cone 23*a* is then free to move upwards and drive out the lower ends of the slips 19*a* which take an initial "bite" on the inner wall of the conduit.

The four shear screws 17*a* retaining the upper cone 15*a* are last to shear and this allows the upper end of the slips 19*a* to be driven out to the conduit wall.

The packing element 11*a* is sufficiently stiff to allow the later shearing mechanisms to take place without scuffing the elastometric material of the packing element 11*a* down the tubing wall.

Once the slip mechanism is engaged, setting motion is confined to downward movement of integers 1*a*, 6*a*, 10*a*, 7*a*, 29*a*, 30*a* and 24*a*. The packing element 11*a* will compress the bulge outwards to fill the annular space between the upper and lower gauge rings 24*a* and 13*a* and the conduit inner wall. As the mechanical setting force is transmitted into the packing element 11*a* through the disk springs 30*a* and locked in by lock ring 6*a*, a predetermined load can be stored in the system which will allow a certain amount of slack off to occur, but still maintain enough energy to maintain the activated sealing capability of the packing element 11*a*. When the tool is fully set a gap indicated by 'D' on FIG. 1 will decrease and a corresponding gap will open up at a point indicated by 'E' on FIG. 1.

The packing element 11*a* on the retrievable bridge plug according to the present invention has an "activated" type of seal. This means that when a predetermined minimum load is applied to the seal it will make sufficient contact with all its containing boundaries to maintain a seal at high or low pressure differentials. These pressure differentials actually assist in maintaining a seal, as the pressure distribution loads the element in areas which push the elastomeric material towards any potential leak path.

Each new size of packing element 11*a* should be tested to establish the minimum pack-off load to initiate a seal. The disc spring 30*a* load is variable and can be designed to cope with any calculated pack-off losses i.e. when a certain element size is known to require a minimum pack-off load of say 15,000 lbs (6818 Kg), the bridge plug can be set with a stored load of 30,000 lbs (13620 Kg). This would allow half the stored load to be lost without loosing the sealing capability.

Pulling Procedure

The "set" position of the retrievable bridge plug is maintained by locking the setting load between the lock ring 6*a* and the lower cone 23*a* and collet on the main mandrel 16*a* at a bearing point K, indicated on FIG. 1. The components of force at K have a tendency to make the collet finger at the lower end of the main mandrel 16*a* collapse inwards, but it cannot because it is supported by a diameter on the inner mandrel 12*a*.

When a pulling tool shown in FIG. 5, is engaged into the fishing neck 3*a* of the retrievable bridge plug it is jarred upwards thus shearing screws 4*a*. Continued upward movement removes the support that the inner mandrel 12*a* gives to the collet on the main mandrel 16*a*. The lower cone 23*a* is no longer locked in between bearing point K and lock ring 6*a*. Continued upward movement causes a pick up shoulder on the inner mandrel 12*a* to contact a shoulder on the main mandrel 16*a*. As the main mandrel 16*a* is picked up the packing element 11*a*, cones 15*a*, 23*a* and slips 19*a* are stretched out to their released position. Shoulders P and Q, indicated in FIG. 1, of the lock ring housing 24*a* and housing 7*a* respectively, may or may not make contact depending on the amount of drag encountered when retrieving the bridge plug.

DESCRIPTION OF A SECOND EMBODIMENT

Illustrated in FIG. 3 is a second embodiment of a retrieval bridge plug according to the present invention. This second embodiment differs from the first embodiment in that in the second the packing element is provided above the disc spring.

Referring to FIG. 3, there is provided a second embodiment of a retrieval bridge plug according to the present invention comprising a setting sleeve 1*b* having a plurality of shear screws 5*b* spaced therearound at or near a lower end thereof. Also at or near the lower end of the setting sleeve 1*b* there is provided a lock ring 6*b* having a ratchet mechanism. Between the lower end of the setting sleeve 1*b* and the lock ring 6*b* there is provided an upper end of a lock ring housing 29*b*. A lower facing end of the lock ring housing 29b, abuts an upper facing surface of a first annular member 100b, a lower facing surface of the first annular member 100b abutting an upper facing surface of a packing element 11b. The external surface of the adjacent upper facing surface of the first annular member 100b and the lower facing surface of the lock ring housing 29b are so shaped as to receive an upper gauge ring 24b therearound. Further, a first o-ring 9b is provided within a first recess in the inner surface of the lock ring housing 29b at or near the lower end thereof.

The lower end of the packing element 11b abuts a gauge ring support 14b the outer surface of which is so shaped so as to receive a lower gauge ring 13b therein, an upper surface of the lower gauge ring 13b also being in abutment with the lower surface of the packing element 11b. A second recess is provided on the inner surface of the gauge ring support 14b at or near the upper end thereof suitable for receiving a second o-ring 9b.

A lower facing surface of the gauge ring support 14b abuts an upper facing surface of a first cylindrical member 29b. At a lower facing end of the first cylindrical member 29b, attached thereto is a disc spring assembly 30b. The disc spring 30b may advantageously take the form of a Belville washer. The lower end of the disc spring 30b abuts an upper facing surface of a housing 7b. Provided between an outer surface of the first cylindrical member 29b and an inner surface at the upper edge of the housing 7b is a housing connector 10b.

A lower facing surface of the housing 7b abuts an upper facing surface of an upper cone 15b which is shear pinned via shear screws 17b to a slip cage 21b. The slip cage 21b has a plurality of apertures spaced substantially equally therearound suitable for allowing the expansion or contraction of a plurality of slips 19b therethrough.

In the interior of the setting sleeve 1b is provided a running head 2b. The running head 2b is attached to the lock ring 6b by a brass set screw (not shown). Further, a lower end of the running head 2b abuts an upper facing surface of a stop ring 8b, a lower end of the stop ring 8b abutting an upper facing surface of the lock ring housing 29b. A lower facing surface of the running head 2b further abuts a main mandrel 16b. The main mandrel 16b has a third recess in the outer surface thereof to receive a split ring 18b, a lower facing surface of the split ring 18b abutting an upper facing edge of the upper cone 15b.

Provided between an outer surface of the main mandrel 16b and the lower end of the slip cage 21b is a lower cone 23b. On an inner surface of the lower cone 23b there is provided a fourth recess for receiving a fourth o-ring 9b. The lower cone 23b is shear pinned to the slip cage 21b via a plurality of shear screws 17b. Also provided between a portion of the inner surface of the slip cage 21b and the outer surface of the lower cone 23b, is a retainer ring 22b.

A lower facing surface of the lower cone 23b abuts an upper facing edge of an accessory cross-over 25b, the accessory cross-over 25b having a fifth recess in the outer surface thereof at or near the upper edge thereof capable of receiving a fifth o-ring 28b. The fifth recess faces a lower portion of the inner surface of the lower cone 23b such that the portion of the inner surface of the lower cone 23b and at least a portion of the outer surface of the accessory cross-over 25b are in contact with one another.

A lower end of the main mandrel 16b is provided with a collet finger 29b, an angled upper facing surface of which contacts a corresponding lower facing surface of the lower cone 23b at a bearing point K.

Extending substantially the length of the plug is an inner mandrel 12b, the outer surface of which is in contact with the inner surface of the main mandrel 16b.

Further provided at an upper facing edge of the inner mandrel 12b is a fishing neck 3b, a lower facing surface of the fishing neck 3b being in abutment with an upper facing surface of the inner mandrel 12b. The fishing neck 3b is further shear pinned to the running head 2b via a plurality of shear screws 4b.

The operation of the plug according to the second embodiment, is substantially the same as that of the first embodiment, and shall, therefore, not be discussed in detail herein.

It should be noted that the inclusion of the biasing means 30a, 30b also acts to improve the releasing function of the bridge plug on retrieval.

Finally, it should be appreciated that, the embodiment of the invention hereinbefore described is given by way of example only and is not meant to limit the scope of the invention in any way. Particularly, it should be appreciated that the examples have been described with reference to a vertical casing or tubing conduit. However, the invention may be used in angled or horizontal conduit, and references herein to "up" and "down" should, therefore, be construed accordingly.

I claim:

1. A retrievable bridge plug for use in a casing or tubing conduit, comprising a plurality of outermost substantially cylindrical members dependent from one another, and a plurality of innermost substantially cylindrical members dependent from one another, a packing element, an outer surface of which is dimensioned to engage an inner surface of the casing or tubing conduit, in use, so as to provide a seal thereat, a plurality of slips dispersed around the outer surface of the plug, and further comprising biasing means held longitudinally between two of the outermost members, wherein, in use, the plug can be set by urging the outermost members and innermost members relative to one another in their longitudinal directions in so doing anchoring the slips and locating the packing element on the inner surface of the casing or tubing conduit, the biasing means providing a predetermined force to the packing element greater than that required to provide the seal whereby the plug is retained within the casing or tubing conduit.

2. A retrievable bridge plug as claimed in claim 1, wherein the biasing means is in the form of a disc spring.

3. A retrievable bridge plug as claimed in claim 1, wherein the baising means is a Belville washer.

4. A retrievable bridge plug as claimed in claim 1, wherein the packing element is made from an elastomeric material.

5. A retrievable bridge plug as claimed in claim 1, wherein the plurality of outermost substantially cylindrical members comprises a setting sleeve, an inner facing surface at a lower end of which is in contact with an outer surface of an upper end of a lock ring housing, a lower facing surface of which is in abutment with an upper end of the biasing means, a lower end of the biasing means being in abutment with an upper facing surface of a housing, a lower facing surface of the housing being in abutment with an upper facing surface of the packing element, a lower facing surface of the packing element being in abutment with an upper facing surface of a gauge ring support, a lower facing surface of the gauge ring support being in abutment with an upper facing surface of an upper cone, an angled lower facing surface at a lower end of an upper cone being in contact with corresponding angled upper facing surfaces of a plurality of slips, the slips having further symmetrical lower facing surfaces which contact a corresponding upper facing surface provided on an upper end of a lower cone, a lower end of the lower cone being in contact with an upper facing surface of an accessory cross-over.

6. A retrievable bridge plug as claimed in claim 5, wherein the plurality of innermost substantially cylindrical members comprises a running head, a lower end of which abuts a lower facing surface of a stop ring, a lower facing surface of the stop ring abutting a further upper facing surface of the housing, wherein a further lower facing surface of the running head abuts an upper facing surface of a main mandrel, the lower end of the main mandrel being provided with a collet finger, an angled upper facing surface of which abuts a corresponding angled lower facing surface of the lower cone, further comprising an inner mandrel, an outer surface of which is in contact with an inner surface of the main mandrel, an upper surface of the inner mandrel being in abutment with a lower facing surface of a fishing neck.

7. A retrievable bridge plug as claimed in claim 1, wherein the plurality of outermost substantially cylindrical members comprises a setting sleeve, an inner facing surface at a lower end of which is in contact with an outer surface of an upper end of a lock ring housing, a lower facing surface of which is in abutment with an upper facing surface of a first annular member, a lower facing surface of which is in abutment with an upper facing surface of the packing element, a lower surface of which is in abutment with an upper facing surface of a gauge ring support, a lower facing surface of the gauge ring support being in abutment with an upper facing surface of a first cylindrical member, a lower facing surface of which is in abutment with an upper end of the biasing means, a lower end of the biasing means being in abutment with an upper facing surface of a housing, a lower facing surface of the housing being in abutment with an upper facing surface of an upper cone, an angled lower facing surface at a lower end of the upper cone bieng in contact with corresponding angled upper facing surfaces of a plurality of slips, the slips having further symmetrical lower facing surfaces which contact a corresponding upper facing surface provided on an upper end of a lower cone, a lower end of the lower cone being in contact with an upper facing surface of an accessory cross-over.

8. A retrievable bridge plug as claimed in claim 7, wherein the plurality of innermost substantially cylindrical members comprises a running head, a lower end of which abuts a lower facing surface of a stop ring, a lower facing surface of the stop ring abutting a further upper facing surface of the lock ring housing, wherein a further lower facing surface of the running head abuts an upper facing surface of a main mandrel, the lower end of the main mandrel being provided with a collet finger, an angled upper facing surface of which abuts a corresponding angled lower facing surface of the lower cone, further comprising an inner mandrel, an outer surface of which is in contact with an inner surface of the main mandrel, an upper surface of the inner mandrel being in abutment with a lower facing surface of a fishing neck.

9. A retrievable bridge plug as claimed in claim 1, wherein the biasing means also acts to improve releasing of the plug on retrieval.

10. A method of locating and retaining a bridge plug within a casing or tubing conduit, the bridge plug comprising a plurality of outermost substantially cylindrical members dependent from one another, and a plurality of innermost substantially cylindrical members dependent from one another, a packing element, an outer surface of which is dimensioned to engage an inner surface of the casing or tubing conduit, in use, so as to provide a seal thereat, and a plurality of slips disposed around the outer surface of the plug, the method comprising setting the plug at a desired position in the casing or tubing conduit by urging the outermost and innermost members relative to one another in their longitudinal directions, in so doing anchoring the slips and locating the packing element on the inner surface of the casing or tubing conduit, and providing a predetermined force to the packing element greater than that required to provide a seal by means of biasing means held longitudinally between two of the outermost members, whereby the plug is retained within the casing or tubing conduit.

* * * * *